US005954554A

United States Patent [19]

Bates

[11] Patent Number: 5,954,554

[45] Date of Patent: Sep. 21, 1999

[54] OUTBOARD DRIVE EXHAUST SYSTEM

[75] Inventor: Glen H. Bates, Port St. Lucie, Fla.

[73] Assignee: Yamaha Hatsudoki Kabushiki Kaisha, Japan

[21] Appl. No.: 08/799,685

[22] Filed: Feb. 11, 1997

[51] Int. Cl.[6] ..... B63H 21/32

[52] U.S. Cl. ..... 440/89; 440/900

[58] Field of Search ..... 440/89, 900, 86; 60/310; 181/237–239

[56] References Cited

U.S. PATENT DOCUMENTS

| | | | |
|---|---|---|---|
| 1,824,740 | 9/1931 | Johnson et al. | 440/89 |
| 2,082,059 | 6/1937 | Irgens | 440/89 |
| 4,023,353 | 5/1977 | Hall | 440/89 |
| 4,601,666 | 7/1986 | Wood, Jr. | 440/89 |
| 5,299,961 | 4/1994 | Okamoto . | |
| 5,348,500 | 9/1994 | Lassanske | 440/89 |

*Primary Examiner*—Ed Swinehart

*Attorney, Agent, or Firm*—Knobbe, Martens, Olson & Bear, LLP

[57] ABSTRACT

An outboard drive involves an improved exhaust system that increases the reverse thrust produced by the outboard drive. The exhaust system includes a first exhaust passage and a second exhaust passage that stems from a first exhaust passage. A flow control device operates within the exhaust system to control exhaust gas flow through second passage depending upon the drive condition (either forward or reverse) of the outboard drive. The flow control device permits exhaust gas flow through the second passage when the outboard drive operates in reverse, while inhibiting exhaust gas flow through the second passage when the outboard drive operates under a forward drive condition. In this manner, the improved exhaust system reduces exhaust gas back pressure and thrust degradation due to exhaust gas entrainment in the propeller when the outboard drive operates in reverse.

42 Claims, 7 Drawing Sheets

OUTBOARD DRIVE EXHAUST SYSTEM

BACKGROUND OF THE INVENTION

FIELD OF THE INVENTION

The present invention relates generally to a marine propulsion system and, more particularly to an exhaust system for an outboard drive.

DESCRIPTION OF RELATED ART

Outboard motors conventionally discharge exhaust gases through a propeller hub into the water in which the outboard motor is operated. The associated exhaust noise is effectively silenced by the submerged discharge of exhaust gases.

When an outboard motor operates under a forward drive condition, the exhaust gases are discharged through the propeller hub into a low pressure region in water behind the propeller. The rotating propeller and the water flow through the propeller form this low pressure region that assists the exhaust flow through the exhaust system. Relatively little back pressure exists in the propeller hub during forward thrust rotation of the propeller.

Under a reverse drive condition, however, a relatively high back pressure exists within the exhaust passage of the propeller hub. The reverse rotation of the propeller and resulting reverse motion of the watercraft induces water to flow into the rearwardly oriented openings of the propeller hub—the same openings through which the engine exhaust gases flow into the surrounding water. This water flow into the propeller hub increases exhaust back pressure. The higher back pressure consequently reduces the operational performance of the outboard motor.

The discharged exhaust gases also tend to cause the propeller to cavitate, further decreasing the performance of the outboard motor when operated in reverse. Under a reverse drive condition, the exhaust gases are discharged into the water upstream of the propeller blades. The gases become entrained within the water flow through the propeller blades and decrease the viscosity of the water around the blades. The presence of the exhaust gases within the water flow through the propeller blades often causes the blades to cavitate. The propeller blades consequently produce less thrust, thereby degrading the perceived thrust and operational performance of the outboard motor.

SUMMARY OF THE INVENTION

The present invention comprises an exhaust passage and valve arrangement for use in an outboard drive which can function to reduce thrust degradation due to exhaust gas entrainment through the propulsion device and excessive exhaust back pressure, at least when the outboard drive operates in reverse.

While the embodiments presented are particularly well suited to an outboard motor with an exhaust outlet disposed in the hub of the propeller, the present invention is equally well suited for incorporation into a stem drive or another type of marine drive in which the exhaust outlet for the exhaust gases is submerged and the exhaust gases are discharged in the vicinity of the propulsion device. Thus, "outboard drive" will be used in the following description and claims to generically mean outboard motors, inboard/outboard motors, and other types of marine drives that utilize submerged exhaust discharge.

One aspect of the present invention thus involves an outboard drive for a watercraft comprising a propulsion device. The propulsion device operates under at least a forward drive condition and a reverse drive condition to propel the watercraft forward and in reverse, respectively. An engine is coupled to the propulsion device to power the propulsion device. An exhaust system is connected to the engine to discharge engine exhaust gases. The exhaust system includes a first exhaust passage that opens at a first discharge end and a second exhaust passage that communicates with the first exhaust passage and opens at a second discharge end. The first discharge end is located at a lower position on the outboard drive than the second discharge end. A flow control device is positioned within the exhaust system. The flow control device is movable between at least a first operational state, in which the flow control device inhibits exhaust gas flow through the second exhaust passage when the propulsion device is operated under the forward drive condition, and a second operational state, in which the flow control device permits exhaust gas flow through the second exhaust passage to the second discharge end when the propulsion device is operated under the reverse drive condition.

In a preferred embodiment, a second exhaust passage is provided in communication with the standard exhaust configuration of an outboard drive. A valve or other restriction device is provided so as to inhibit the flow of exhaust gases through the second passage during the forward operation of the outboard drive motor, thereby venting the majority of exhaust gases below the water line through the propeller hub. When the outboard drive motor is operated in the reverse direction, an actuator (either mechanical, hydraulic or electrical) opens the valve or other restriction device, thereby allowing exhaust gases to pass through the second exhaust passage, venting a substantial portion of these exhaust gases either above or just below the water line. Engine exhaust noise thus is minimized during forward operation of the engine while allowing for improved outboard drive performance when the outboard drive motor is operated in reverse.

Another aspect of the invention involves an outboard drive for a watercraft comprising a propulsion device. A transmission cooperates with the propulsion device to selectively establish at least a forward or a reverse drive condition for the propulsion device. An engine is coupled to the propulsion device to power the propulsion device. An exhaust system is connected to the engine to discharge engine exhaust gases from the outboard drive. The exhaust system includes at least one exhaust passage and a flow control device positioned within the exhaust system to regulate exhaust gas flow through at least a portion of the exhaust passage. A shift actuator is coupled to the transmission to control the operating condition of the propulsion device. The shift actuator also is coupled to the flow control device to control exhaust flow gases through the exhaust passage.

In accordance with an inventive method for improving reverse thrust in an outboard drive, an engine is provided which drives a propulsion device and includes at least one exhaust port. An exhaust system communicates with the exhaust port of the engine and includes a first exhaust passage and a second exhaust passage. The first passage terminates at a first discharge end and the second passage terminates at a second discharge end. A flow control device is arranged within the exhaust system to control exhaust gas flow through the second passage. A transmission also is provided to selectively establish at least a forward and a reverse drive condition for the outboard drive. The first discharge end is positioned at a location that normally lies submerged in the body of water in which the outboard drive is operated and the second discharge end is positioned at a location that normally is open to the atmosphere, partially submerged, or just below the waterline with the outboard drive operating in the body of water. In any of these positions, the second discharge end lies at a position on the outboard drive higher than the position of the first discharge end. The flow control valve is operated to permit exhaust gas flow through the second passage when the transmission establishes a reverse drive condition for the outboard drive. In this manner, at least a portion of the exhaust gases from the engine are discharged through the second passage and the associated discharge end when the outboard drive is operated in reverse to reduce exhaust back pressure and to eliminate exhaust gas entrainment in the propulsion device (e.g., propeller). As a result, the reverse thrust produced by the outboard drive increases.

Other objects, features and advantages of the present invention will become more readily apparent from the following detailed description of preferred embodiments which are intended to illustrate and not to limit the invention.

BRIEF DESCRIPTION OF THE DRAWINGS

The accompanying drawings illustrate several preferred embodiments of the invention. The drawings contain the following views.

DETAILED DESCRIPTION OF PREFERRED EMBODIMENTS OF THE INVENTION

Several embodiments of the exhaust system designed to carry out the reverse thrust improvement of this invention are disclosed herein. Each of these embodiments employs the same basic concepts characteristic of the improved features of this invention, namely an increase in the thrust and performance of an outboard drive when operating in reverse.

Figure 1B:
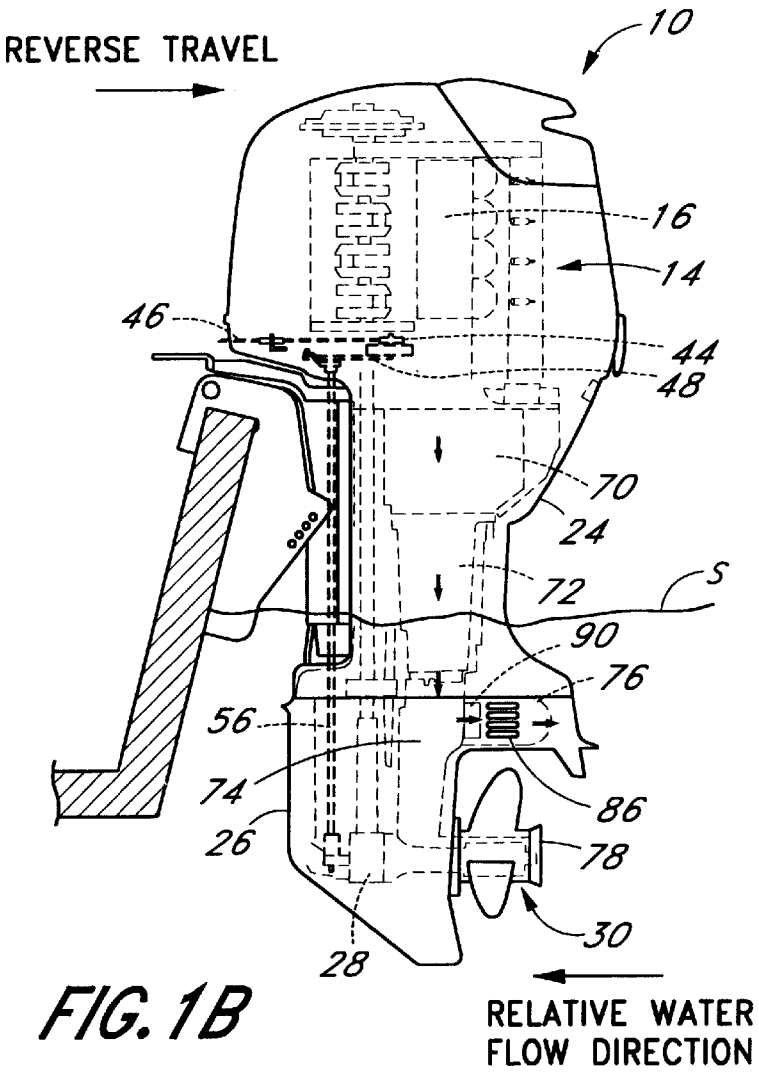
FIG. 1B is a side elevational view of the outboard motor of FIG. 1A illustrating an exhaust flow path through the exhaust system when the outboard motor is operated in reverse.
Figure 1A:
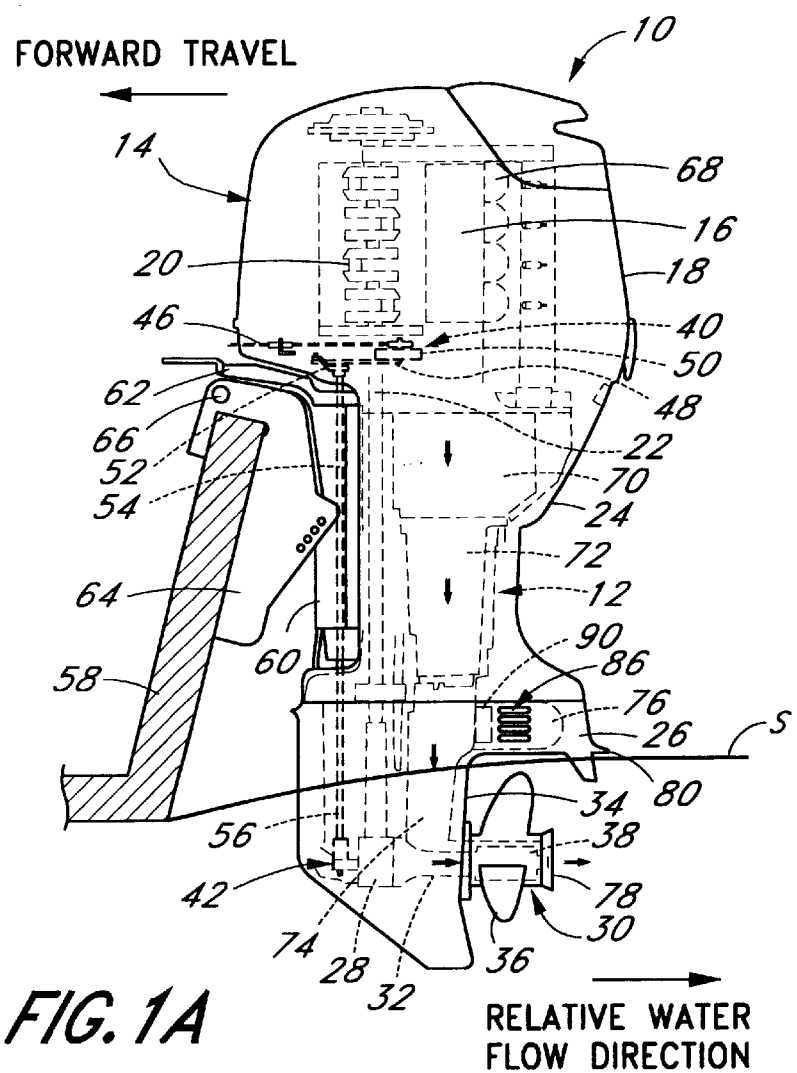
FIG. 1A is a side elevational view of an outboard motor that employs an exhaust system configured in accordance with the present invention, and illustrates an exhaust flow path through the exhaust system when the outboard motor is operated under a forward drive condition.

FIG. 1A illustrates an outboard drive 10 which incorporates an exhaust system 12 configured in accordance with a preferred embodiment of the present invention. The present exhaust system has particular utility with an outboard motor, and thus, it is described below in connection with such a drive. However, the description of the invention in conjunction with the illustrated outboard motor is merely exemplary.

The outboard motor 10 has a power head 14 that includes an internal combustion engine 16. In the illustrated embodiment, the engine 16 includes four in-line cylinders that operate on a four-stroke principle; however, the present exhaust system 12 can be used with engines having other numbers of cylinders and other cylinder orientations, as well as operating on other combustion principles (e.g., a two-stroke, crankcase compression principle). A protective cowling 18 surrounds the engine 16.

As is typical with the outboard motor practice, the engine 16 is supported within the power head 14 so that its output shaft 20 (i.e., a crankshaft) rotates about a generally vertical axis. The crankshaft 20 is coupled to a drive shaft 22 that depends through and is journalled within a drive shaft housing 24.

The drive shaft housing 24 extends downward from the cowling 18 and terminates at a lower unit 26. The drive shaft 22 extends into the lower unit 26 to drive a transmission 28 housed within the lower unit 26. The transmission 28 selectively establishes a driving condition of a propulsion device 30. In particular, the transmission 28 selectively couples the drive shaft 22 to at least one propulsion shaft that drives the propulsion device 30. The transmission 28 desirably is a forward/neutral/reverse-type transmission so as to drive the associated watercraft in any of these operational states.

In the illustrated embodiment, the propulsion shaft lies at about a 90 degree shaft angle relative to the drive shaft 22. The propulsion shaft extends rearward from the transmission 28 and through a bearing carrier 32, and projects beyond a rear wall 34 of the lower unit 26. The propulsion shaft supports at least a portion of the propulsion device 30 behind the lower unit rear wall 34.

The propulsion device 30 in the illustrated embodiment is a propeller that has a plurality of propeller blades 36 radiating from a propeller hub 38. This embodiment of the propulsion device 30, however, is merely exemplary. The present invention can be used with other types of propulsion devices, such as, for example, but without limitation, counter-rotating dual propeller systems, jet pumps and the like.

A transmission actuator 42 moves a clutching element of the transmission 28 to selectively establish a drive condition for the propulsion device 30. In particular, the transmission actuator 42 moves the transmission clutching element between a forward drive position, to rotate the propulsion shaft in a forward drive direction, a neutral position, and a rear drive position, to rotate the propulsion shaft in a reverse drive direction.

A shift actuator 40 operates the transmission actuator 42. In the illustrated embodiment, the shift actuator 40 includes a fitting 44 positioned at the end of a shift cable 46. The fitting 44 also is coupled to an end of a link 48. A pivot pin of the shift actuator 40 interconnects the cable fitting 44 and the link 48 in order to permit relative rotational movement between these components. A guide mechanism 50 of the shift actuator 40 supports the pivotal coupling between the cable fitting 44 and the link 48. An opposite end of the link 48 is connected to an end of a shift control lever 52. A pivot pin couples together the ends of the link 48 and the lever 52 to allow relative rotational movement between these components of the shifting actuator 40.

A shift control rod 54 is fixed to the lower portion of the shift lever 52. The shift control rod 54 depends from the power head 14. A lower shift control rod 56 is splined to the lower end of the upper shift control rod 54 and depends into the lower unit 26 to a point near the transmission 28. The lower shift control rod 56 operates the transmission actuator 42 to change the drive condition of the transmission 28.

The outboard motor 10 is attached to a transom 58 in a manner permitting the motor 10 to swivel relative to the watercraft's transom 58. For this purpose, a steering shaft is affixed to the drive shaft housing 24 by upper and lower brackets. The brackets support the steering shaft for steering movement within a swivel bracket 60. Steering movement occurs about a generally vertical steering axis which extends through the steering shaft. A steering arm 62 is connected to an upper end of the steering shaft and extends in a forward direction for manual steering of the outboard motor 10, as known in the art.

The swivel bracket 60 also is pivotally connected to a clamping bracket 64 by a pin 66. The clamping bracket 64, in turn, is configured to attach to the transom 58 of the watercraft. The clamping bracket 64 is arranged on the transom 58 at a location which supports the outboard drive 10 at a position where the propeller blades 36 of the propeller 30 lies beneath the surface level S of the body of water in which the watercraft is operated, at least when the outboard motor 10 is operated in reverse.

The conventional coupling between the swivel bracket 60 and the clamping bracket 64 permits adjustment of the trim position of the outboard motor 10, as well as allows the outboard motor 10 to be tilted up for transportation or storage. For this purpose, a conventional tilt and trim cylinder assembly (not shown) can operate between the clamping bracket 64 and the swivel bracket 60.

The construction of the outboard motor 10 as thus far described is considered to be conventional, and for that reason further details of the construction are not believed necessary to permit those skilled in the art to understand and practice the invention.

In order to facilitate the description of the present invention, the terms "front" and "rear" are used to indicate the relative positions of the components of the outboard motor 10 and the exhaust system 12. As used herein, "front" refers to the side closest to the transom 58, while "rear" refers to the side furthest from the transom 58. Several of the figures include labels to further aid the reader's understanding.

The exhaust system 12 discharges engine exhaust from an engine manifold 68 of the engine 16. The engine manifold 68 communicates with an exhaust conduit formed within an exhaust guide positioned at the upper end of the drive shaft housing 24. The exhaust conduit of the exhaust guide opens into an expansion chamber 70. The expansion chamber 70 is formed within the drive shaft housing 24 and communicates with a discharge conduit 72 that extends to a lower end of the drive shaft housing 24.

The exhaust system 12 also includes a first exhaust passage 74 and at least a second exhaust passage 76. The first passage 74 desirably extends through the lower unit 26 to discharge engine exhaust gases through the propeller hub 38. In the illustrated embodiment, the first exhaust passage 74 extends from an upper end of the lower unit 26 into the lower unit 26 in a direction generally parallel to the longitudinal axis of the drive shaft 22. The first passage 74 lies behind the drive shaft 22 and the transmission 28 within the lower unit 26. At a point near the transmission 28, the first exhaust passage 74 turns to run along the bearing carrier 32 and through an opening formed on the rear wall 34 of the lower unit 26. The first exhaust passage 74 thence passes through the propeller hub 38 and terminates at a first discharge end 78 that lies on the rear side of the propeller hub 38.

The second passage 76 communicates with the first passage 74 and provides an alternative flow path under a reverse drive condition. The second passage 76 desirably has a sufficient cross-sectional flow area to function at least as a primary exhaust passage when the outboard motor 10 is operated in reverse. Because of space confines, however, the second passage 76 can have a smaller cross-sectional flow area than the first passage 74.

Figure 2:
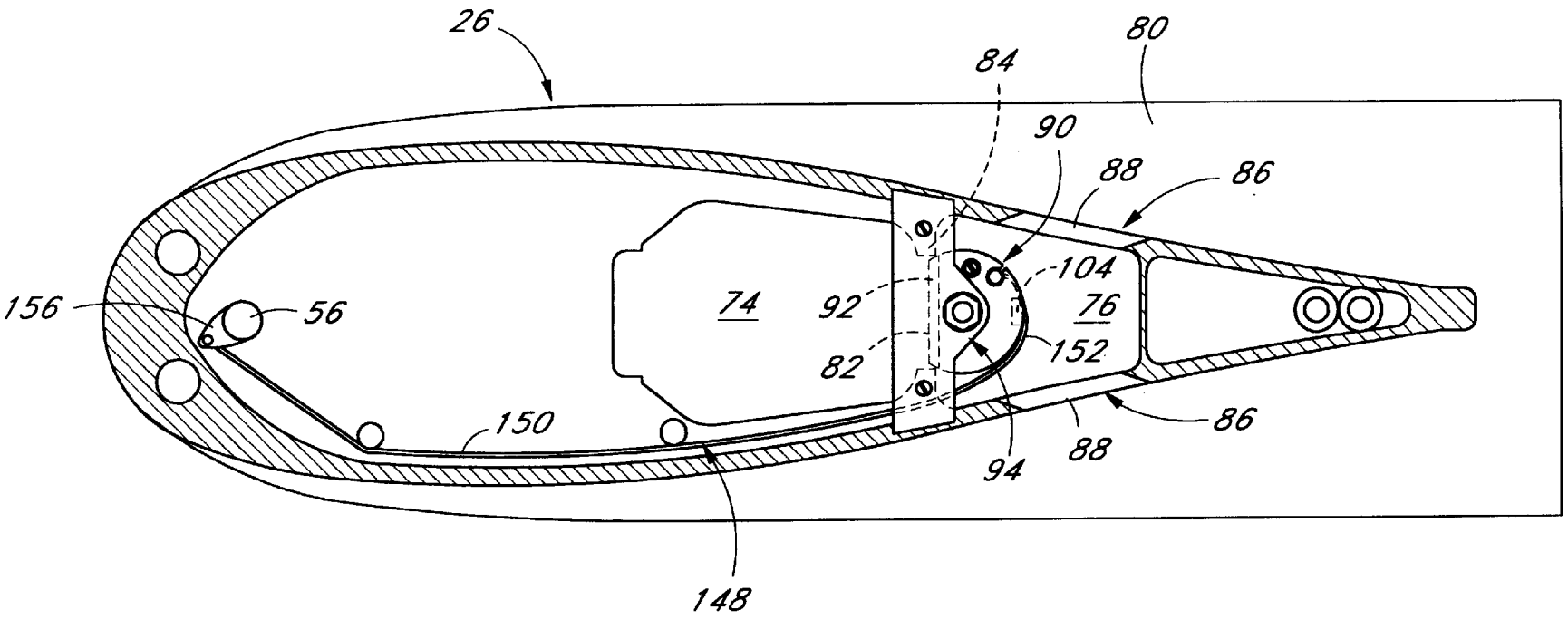
FIG. 2 is a top plan view of a lower unit of the outboard motor of FIG. 1A illustrating an exhaust valve assembly positioned within a second exhaust passage of the exhaust system.

The second passage 76 also desirably extends through the lower unit 26. In the illustrated embodiment, as best seen in FIGS. 1A and 2, the second passage 76 runs along an upper portion of the lower unit 26 above a cavitation plate 80. The cavitation plate 80 extends over the propulsion device 30. The second passage 76 communicates with the first passage 74 through an opening 82 formed in an internal wall 84 of the lower unit 26 that defines a rear surface of the first passage's upper end. The second passage 76 terminates at a second discharge end 86.

The second discharge end 86 is located toward the rear side of the lower unit 26 and is formed by at least one aperture that passes through an external wall of the lower unit 26. In the illustrated embodiment, the second discharge end 86 includes a plurality of slot-like openings 88 located on at least one side of the lower unit 26, and desirably on both sides of the lower unit 26, near the lower unit's rear end. As seen in FIG. 2, each slot opening 88 advantageously is obliquely oriented relative to the propulsion shaft axis in order to inhibit water flow into the second exhaust passage 76 under forward drive conditions.

The exhaust system 12 includes a flow control device 90 to control exhaust gas flow through the second exhaust passage 76. The flow control device 90 desirably inhibits exhaust gas flow through the second passage 76 when the outboard motor 10 operates under a forward drive condition and permits exhaust gas flow through the second passage 76 when the outboard motor 10 operates in reverse. The flow control device 90 desirably fully closes the second exhaust passage 76 from the first passage such that the vast majority of exhaust gases flow through the first passage 74 when the outboard motor 10 operates under a forward drive condition; however, a small percentage of the exhaust gas flow (e.g., less than 20%) can flow through the second passage 76 under the forward drive condition. In addition, the flow control device 90 also can prevent flow through the first passage 74 when the outboard motor 10 operates in reverse; however, this is not necessary to obtain significant thrust improvement under reverse drive conditions. Exhaust gases can flow through the first exhaust passage 74 when the outboard motor 10 operates in reverse, but the volume of the exhaust gas flow through the first passage 74 under this operating condition desirably is less than the volume of exhaust gas flow through the first passage 74 when the outboard motor 10 operates under a forward drive condition.

With reference to FIG. 2, the flow control device 90 desirably includes a valve plate 92 that moves between a first position (e.g., a closed position), in which the plate 92 inhibits exhaust gas flow through the second exhaust passage 76, and a second position (e.g., an open position), in which the plate 92 does not meaningfully impede exhaust gas flow through the second passage 76. The valve plate 92 desirably lies within the second passage 76 when located in both of its first and second positions; however, the valve plate 92 can alternatively operate between the first and second passages 74, 76. In such case, at least a portion of the valve plate 92 can lie at a position within the first passage 74 when the valve plate is moved into the second (e.g., open) position. The valve plate 92 consequently need not operate entirely within the second passage 76.

Figure 3:
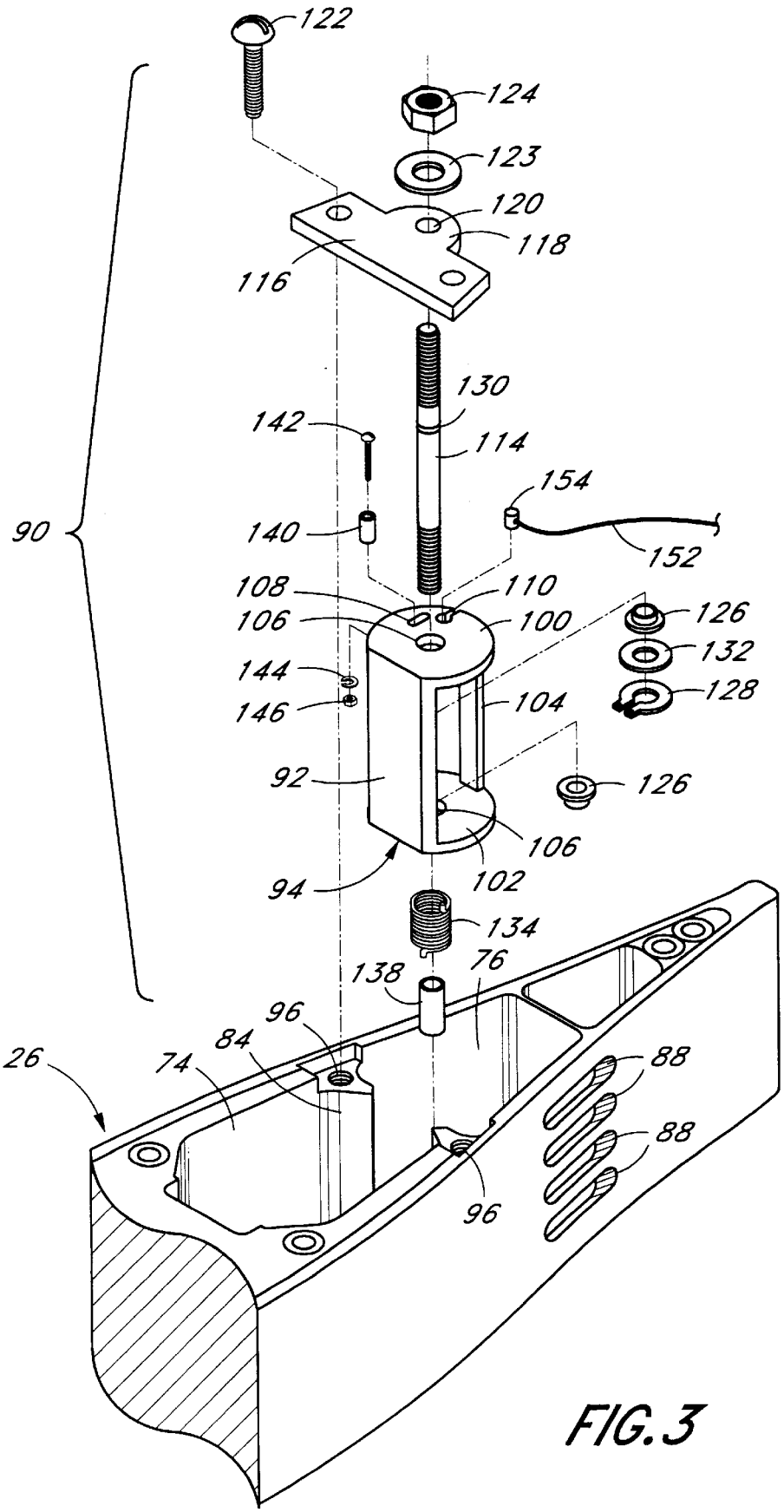
FIG. 3 is an exploded perspective view of an exhaust valve assembly of FIG. 2.
Figure 4:
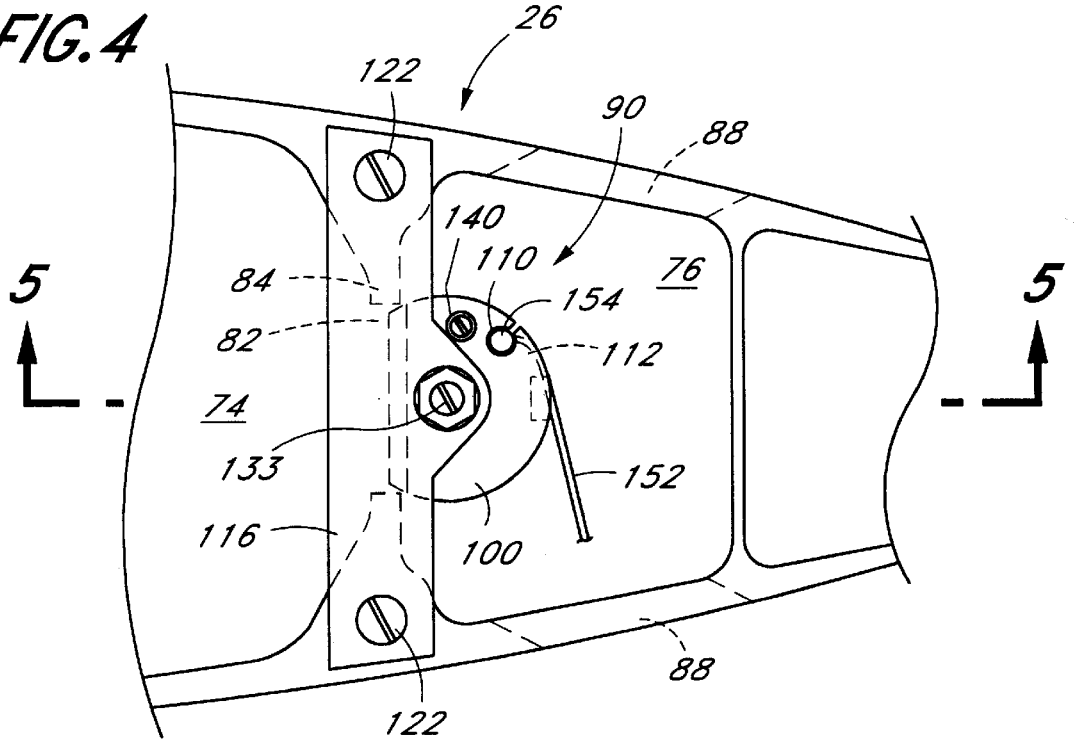
FIG. 4 is an enlarged partial top plan view of the lower unit and the exhaust valve.
Figure 5:
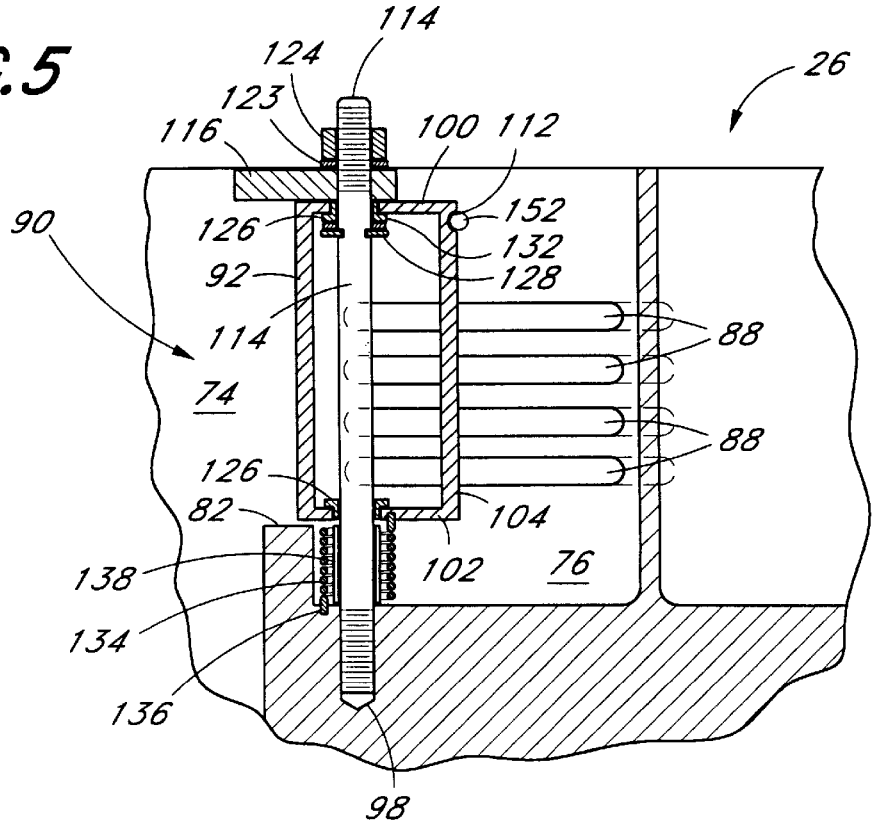
FIG. 5 is a cross-sectional view of the exhaust valve assembly of FIG. 3 taken along lines 5—5.

In the illustrated embodiment, as best seen in FIGS. 3 through 5, the flow control device 90 is a valve assembly that includes a rotary valve 94. It is understood, however, that other types of valves, such as, for example, but without limitation, gate valves, butterfly valves, flapper valves, ball valves, and the like, also can be used as part of the flow control device.

The valve assembly 90 also includes a valve seat with which the rotary valve 94 cooperates. In the illustrated embodiment, the valve seat is located at the intersection between the first and second exhaust passage 74, 76. The valve seat, however, can be located at other locations within the exhaust system 12. For instance, the valve seat can lie at any point between the passage intersection and the second discharge end 86.

The valve seat in the illustrated embodiment is formed by the opening 82 that passes through the internal wall 84 of the lower unit 26. As best understood from FIGS. 3 through 5, a pair of threaded mounting holes 96 are formed atop the internal wall 84 on either side of the opening 82, and a lower threaded mounting hole 98 (FIG. 5) is formed on the floor of the second passage 76 at a point behind the opening 82. The lower mounting hole 98 is symmetrically located relative to the opening 82 and is spaced behind the opening 82 by a distance that corresponds to the distance between the valve plate 92 and the rotational axis of the valve 94, as described below.

The valve plate 92 is sized to inhibit exhaust gas flow through the opening 82 when the valve plate 92 lies within the opening 82 in a first position. As best seen in FIGS. 4 and 5, the valve plate 92 desirably is substantially coextensive with the opening 82 so as to substantially close the opening 82 when in the first position. In the illustrated embodiment, the opening 82 and the plate 92 have similarly sized rectangular shapes.

As understood from FIGS. 3 through 5, the valve plate 92 forms a portion of the rotary valve 94. The rotary valve 94 also includes an upper bearing plate 100 connected to an upper end of the valve plate 92 and a lower bearing plate 102 connected to a lower end of the valve plate 92. Each bearing plate 100, 102 has a truncated circular shape with the valve plate 92 positioned along the resulting truncated cord length. A strut 104 interconnects the bearing plates 100, 102 on a side of the plates diametrically opposing the valve plate 92.

Bearing holes 106 are formed at the center of each bearing plate 100. 102. The axes of the bearing holes 106 are aligned and define the rotational axis of the valve 94. The upper bearing plate 100 also includes an adjustment slot 108 and a mounting aperture 110 that lies behind and to the side of the bearing hole 106. A support groove 112 (FIG. 4) extends about a rear portion of the upper bearing plate's periphery and runs into the mounting aperture 110. The mounting aperture 110 and support groove 112 are configured to cooperate with a valve operator coupling, as described below.

A valve shaft 114 supports the rotary valve 94 behind the valve seat. In the illustrated embodiment, the valve 94 rotates about the shaft 114. With another type of valve (e.g., butterfly valves), however, the valve alternatively can rotate with the support shaft.

As best seen in FIG. 5, the valve shaft 114 includes threaded ends. When assembled, the lower end of the valve shaft 114 is threaded into the lower mounting hole 98. The valve shaft thus extends in a direction generally parallel to the drive shaft 22 in the illustrated embodiment.

A support plate 116 supports the upper end of the valve shaft 114. The support plate 116 has an elongated shape with mounting holes positioned at either end. The length of the plate 116 is sized to fit between the exterior walls of the lower unit 26 at a point above the valve seat (i.e., the opening 82) and the internal wall 84. A lug 118 projects from a rear side of the plate 116 and extends over the central portions of the valve's bearing plates 100, 102. The lug 118 includes a through hole 120 that aligns with the bearing holes 106 of the rotary valve 94 and with the threaded hole 98 in the lower unit 24. Bolts 122, that cooperate with the mounting holes 96 on the internal wall 84, secure the mounting plate 116 atop the wall 84 and in the position aligning the holes 120, 106, 98.

The valve shaft 114 extends through the aligned holes 106, 120 of the valve's bearing plates 100, 102 and of the support plate 116. A washer 123 and nut 124 are placed over and threaded onto the upper end of the shaft 114 to secure the shaft upper end to the support plate 116.

As best understood from FIGS. 3 and 5, bushings 126 are located within and press-fit into the bearing holes 106 of the upper and lower plates 100, 102 to support and maintain the axial alignment of the rotary valve 94 on the valve shaft 114. An e-ring retainer 128 supports the upper bushing 126 on the shaft 114. The e-ring retainer 128 cooperates with an annular groove 130 formed about the valve shaft 114 at a point just below the position at which the upper bearing plate 100 lies. A washer 132 is placed between the e-ring retainer 128 and the upper bushing 126 to locate the upper bushing 126 in the corresponding bearing hole 106 and to provide a bearing surface between the e-ring retainer 128 and the upper bushing 126.

The valve shaft 114 includes a slot 133 at its upper end. The slot is sized to receive an end of a screw driver. This allows the shaft 114 to be easily rotated for vertical adjustment of the rotary valve 94 relative to the valve seat to more closely align the valve plate 92 with the opening 82. The slot 133 also can be used to hold the shaft 114 stationary once the valve 94 is adjusted when tightening the nut 124 against the support plate 116.

The valve plate 92 desirably is biased toward the closed position illustrated in FIG. 4. For this purpose, a biasing member 134 operates between the rotary valve 94 and a stationary component of the outboard drive 10. In the illustrated embodiment, a torsion spring 134 operates between the lower bearing plate 102 of the rotary valve 94 and the floor of the second passage 76. The torsion spring 134 includes straight offset ends. One end of the spring is inserted into a hole 136 (FIG. 5) in the passage floor and the other end is inserted into a hole in the valve's lower bearing plate 102.

As best seen in FIG. 5, a spacer 138 supports the lower bearing plate 102 above the spring 134. The spacer 138 lies between the valve shaft 114 and the torsion spring 134 and is interposed between the valve lower plate 102 and the passage floor.

The arrangement of the spring 134 and bushings 126 in the valve assembly 90 generally isolates these components from the exhaust gas flow through the valve assembly 90. The useful life of these components consequently is increased by positioning them out of the exhaust stream that frequently has a temperature ranging between 200 and 300 degrees Fahrenheit or higher.

A stop 140 prevents the spring 134 from rotating the valve plate 92 beyond the closed position. In the illustrated embodiment, the stop 140 has a cylindrical shape and is attached to an upper side of the valve's upper bearing plate 100. A screw 142 passes through a hole in the stop 140 and through the slot 108 of the upper bearing plate 100 to attach the stop 140 to the rotary valve 94. A lock washer 144 and nut 146 secure the screw 142 and stop 140 atop the bearing plate 100.

The slot 108 provides variable positions for the stop 140 relative to the support plate lug 118. This allows the position of the stop 140 to be adjusted such that the stop 140 contacts the lug 118 at the point where the valve plate 94 lies in the fully closed position.

As understood from FIG. 2, a valve operator 148 operates between a component of the shift actuator 40 and the flow control device (e.g., the rotary valve) to move the flow control device between first and second positions depending upon the operating condition of the outboard drive 10. As noted above, the flow control device desirably lies in the first position to inhibit flow through the second exhaust passage 76 when the outboard motor 10 operates under a forward drive condition. And when the shift actuator 40 actuates the transmission 28 to establish a reverse drive condition, the shift actuator 40 also causes the valve operator 148 to move the flow control device into the second position to allow exhaust gas flow through the second exhaust passage 76.

In the illustrated embodiment, the valve operator 148 moves the rotary valve 94 between the closed position, in which the valve plate 92 lies across the opening 82 in the internal wall 84, to an open position, in which the valve plate 92 lies generally parallel to a flow axis through the second passage 76. Other embodiments, however, can involve a valve plate 92 that does not fully close or fully open the flow path into the second exhaust passage 76 when in the first and second positions. Flow through the second passage 76 need only be inhibited or restricted under some conditions and be promoted under other conditions.

An end of the valve operator 148 is coupled to the rotary valve 94. In the illustrated embodiment, the valve operator 148 includes a bowden-wire cable 150. One end of the cable's wire 152 extends beyond the cable shroud and terminates at a solid cylindrical nub 154. The end of the wire 152 is embedded in the cylindrical nub 154 that lies generally transverse to the axis of the wire 152.

When assembled, the bowden-wire 152 wraps around a portion of the peripheral edge of the upper bearing plate 100 in a direction about the rotational axis of the valve 94 opposite to the direction that the torsion spring 134 biases the valve 94. As best seen in FIGS. 2 and 3, the end of the wire 152 lies within the support groove 112 on the plate's peripheral edge while the cylindrical nub 154 is positioned within the mounting aperture 110.

An opposite end of the bowden-wire cable 150 is attached to a portion of the shift actuator 40. In the illustrated embodiment, the opposite end is connected to a lever 156 affixed onto the lower shift rod 56. The coupling between the wire 152 and the lever 156 causes the wire 152 to move with rotation of the lever 156.

As seen in FIG. 2, the bowden-wire cable 150 desirably is unobtrusively arranged within the lower unit 26 and does not interfere with any of the other components housed within the lower unit 26. The cable shroud is supported at various points along the cable's length to prevent relative movement between the shroud and the lower unit 26. The wire 152, however, freely slides within the cable shroud in order to operate the valve upon movement of the shift rod lever 156.

Figure 6:
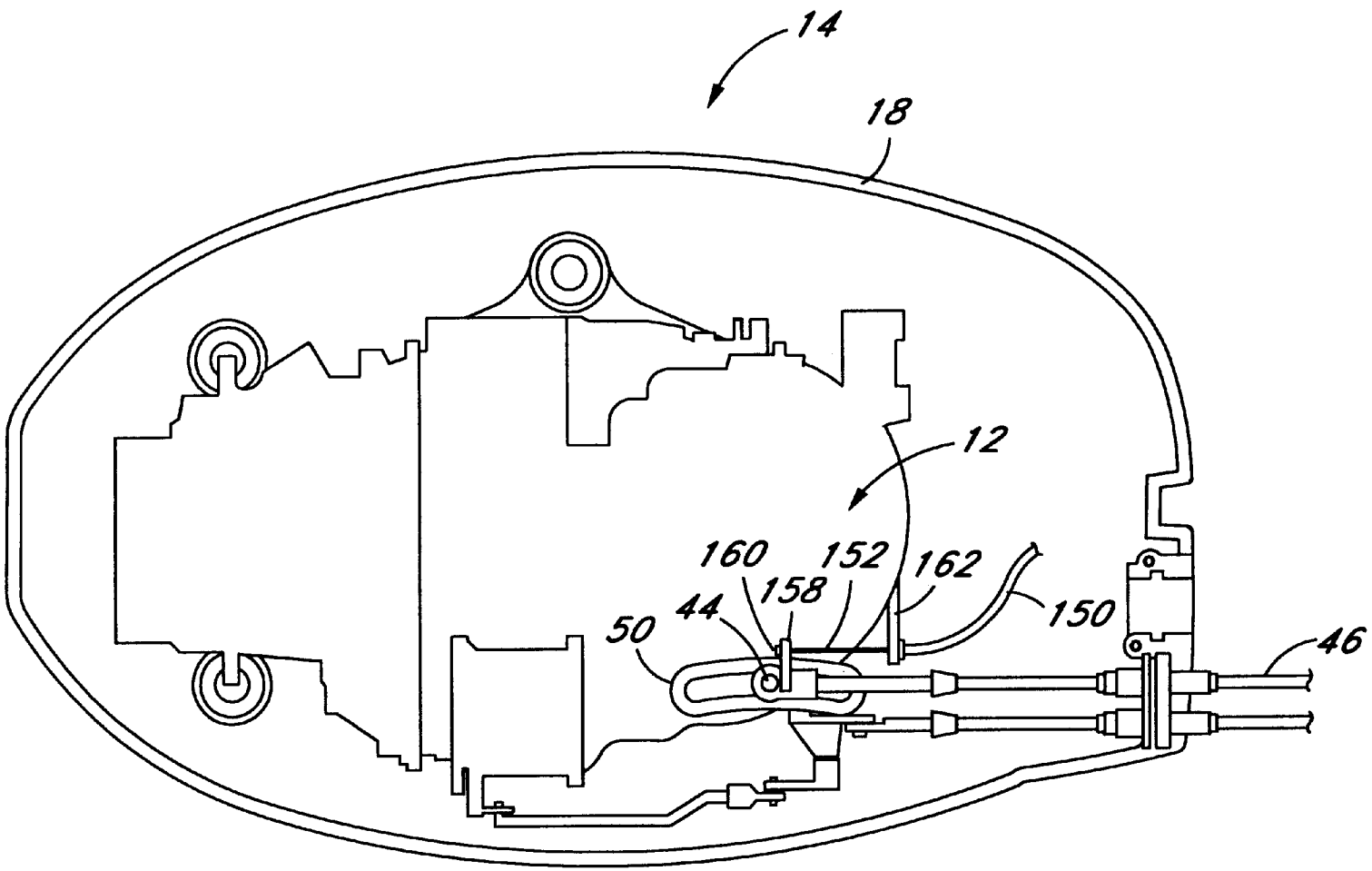
FIG. 6 is a plan view taken through a lower section of a power head of an outboard motor, and illustrates another embodiment of a valve actuation mechanism which can be used to actuate the exhaust valve of the present exhaust system.

Other arrangements of the valve operator also are possible. For instance, as illustrated in FIG. 6, the opposite end of the bowden-wire cable 150 can cooperate with another component of the shift actuator 40. In this embodiment, the bowden wire cable 150 is routed up to the power head 14, either through the drive shaft housing 24 or through the swivel bracket assembly 60, or possibly on the drive shaft housing's exterior.

The upper end of the cable wire 152 is attached to a lug 158 carried by the fitting 44 at the end of the shift cable 46. For attachment, the upper end of the wire 152 extends beyond the cable shroud and terminates at a solid cylindrical nub 160. The end of the wire 152 is embedded in the cylindrical nub 160, similar to the wire's lower end. A bracket 162, which is mounted to the engine 12, fixedly supports the upper end of the cable should.

The cylindrical nub 160 cooperates with the lug 158 to attach the valve cable wire 152 to the fitting 44 at the end of the shift wire 46. In this manner, the cable wire 152 of the valve operator 148 tracks the movement of the shift cable wire 46 when moving between positions that correspond to forward and reverse drive conditions. Only movement from a neutral position to a reverse position of the fitting 44, however, causes the valve 94 to open.

In addition to alternative arrangements of the valve operator cable, other types of valve operator also can be used to interconnect the shift actuator (or a remote shift operator) and the flow control device. For instance, a hydraulic or an electric operator can be used to actuate the flow control device in response to movement of the shift actuator into a position that establishes a reverse drive condition. One possible embodiment can involve an electrical system that includes a fly-by-wire and a remote actuator coupled to the valve. Of course, any of a variety of operators which are known to those skilled in the art can be used to actuate the valve when the driver of the watercraft throws the outboard motor into reverse.

The following will now elaborate upon the operation of the outboard motor 10 and its exhaust system 12 with primary reference to FIGS. 1A, 1B, 2, 7 and 8. A remote shift operator (not shown) causes the shift cable 46 to move the link 48 forward and rotate the shift rod 56 to actuate the transmission 28. So moved, the transmission 28 transmits power from the drive shaft 22 to the propulsion shaft to drive the propulsion device 30 in a direction asserting a forward thrust. The transmission 28 thus establishes a forward drive condition for the outboard motor 10. The corresponding movement of the shift rod 56, when establishing a forward drive condition, does not actuate the rotary valve 94, however. The movement is rather lost either in slack in the valve operator cable 150 or through a lost motion connection located between the shift rod 56 and the rotary valve 94. (A similar result occurs within the valve operator arrangement of FIG. 6.)

Figure 7:
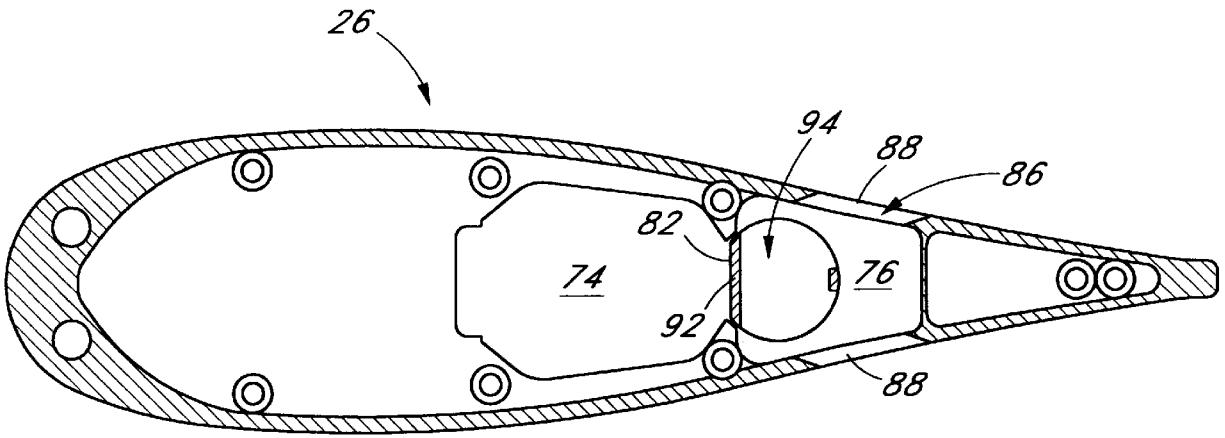
FIG. 7 is a schematic top plan view of the lower unit and illustrates the exhaust valve in a closed position that corresponds to a forward drive condition of the outboard motor.

As seen in FIGS. 1A and 7, the valve plate 92 desirably closes the second passage 76 when the outboard motor 10 operates under a forward drive condition (as well as when the outboard motor is idling under a neutral drive condition). The valve stop 140 contacts a rear edge of the support's lug 118 in this closed position, thereby preventing the torsion spring 134 from rotating the rotary valve 94 beyond its closed position when the valve 94 is not actuated.

During neutral and forward drive operations of the outboard motor 10, exhaust gases generated by the engine 16 travel through the upper end of the exhaust system 12 into the expansion chamber 70. At least a substantial portion of the exhaust gases thence flow from the expansion chamber 70, through the first passage 74 in the lower unit 26 and out through the propeller hub 38. In this manner, the exhaust gases are discharged into a low pressure region that exists within the water behind the propeller 30 and are silenced within the water. Discharge into the low pressure region also promotes exhaust gas flow through the exhaust system 12 to reduce back pressure.

In the illustrated embodiment, substantially no exhaust gases flow through the second passage 76 when the outboard motor operates under the neutral or forward drive conditions in order to maximize the silencing effect of exhaust noise achieved by submerged discharge. It is understood, however, that the exhaust system 12 can be designed to discharge a portion of the exhaust gases through the second passage 76 or through an auxiliary passage under at least forward drive conditions, especially at high speed or under high loads, in order to further reduce the back pressure within the exhaust system 12.

To establish a reverse drive condition, a remote shift operator causes the shift cable 46 and the link 48 to move rearward and rotate the shift rod 56 to actuate the transmission 28. So moved, the transmission 28 transmits power from the drive shaft 22 to the propulsion shaft to drive the propulsion device 30 in a direction asserting a reverse thrust. The corresponding movement of the shift rod 56, when establishing the reverse drive condition, also rotates the lever 156 in a corresponding direction (in a clockwise direction in the view shown in FIG. 2). The valve cable wire 152 follows this movement and causes the valve 94 to rotate about the valve shaft 114. The length of the lever 156 causes sufficient axial displacement of the valve cable wire 152 to move the valve 94 into the open position. When the outboard motor 10 is shifted out of reverse, the opening force on the valve cable 152 is removed allowing the biasing force provided by the torsion spring 134 to rotate the rotary valve 94 to its normal closed position.

Figure 8:
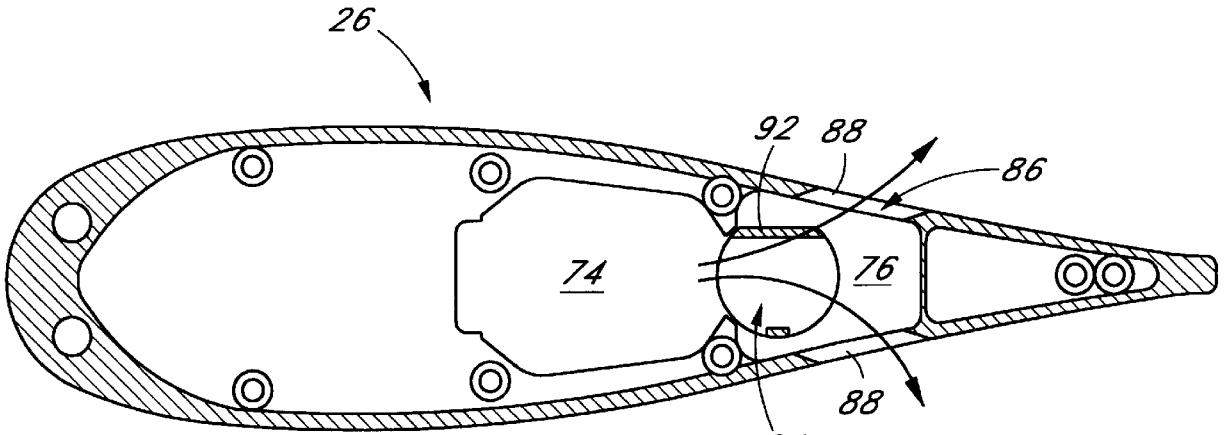
FIG. 8 is a schematic top plan view of the lower unit of the lower unit and illustrates the exhaust valve in an open position that corresponds to a reverse drive condition of the outboard motor.

As schematically illustrated in FIGS. 1B and 8, a substantial portion of the exhaust gases from the expansion chamber 70 flow through the second passage 76 when the outboard motor 10 operates in reverse. When the valve 94 is open, at least a majority of exhaust gases pass from the first exhaust passage 74, through the valve seat and rotary valve 94, into and through the second exhaust passage 76 and subsequently out the second discharge end 86. This flow is caused in large part by the relatively high fluid pressure that exists at the first discharge end 78 as a result of water flow into the propeller hub 38 and a lower portion of the first passage 74 during reverse drive conditions.

The exhaust gases generally flow freely through the second passage 76 and out through the openings 88 at the second discharge end 86 that lies at a vertical level above the first discharge end 78. The second discharge end 86 desirably lies fully above, at (i.e., partially submerged), or just below the water level S to allow the exhaust gases to generally flow freely through the second discharge end 86 when the outboard motor 10 operates in reverse. For this purpose, if the second discharge end 86 is submerged, the second discharge end 86 lies at a shallower depth than the first discharge end 78. The second discharge end 86, however, desirably lies not more than about 12 inches beneath the water level S, and more desirably not more than 6 inches beneath the water level S.

In the illustrated embodiment of the exhaust system, some portion of the exhaust gases can flow through the first exhaust passage 74 with the outboard motor 10 operating in reverse. The volumetric percentage of the total exhaust gas flow through the first discharge end 78, however, is less under the reverse drive condition than the volumetric percentage of the total exhaust gas flow through the first discharge end 78 under the forward drive condition.

As a result of engine exhaust discharge at least principally through the upper second discharge end 86 when the outboard motor 10 operates in reverse, the reverse thrust performance of the outboard motor is increased. This result has been empirically proven. The thrust produced by a standard outboard motor when operated in reverse was first measured at various propeller speeds (measured in revolutions per minute). The outboard motor was then modified to include a second exhaust passage and valve assembly in the form described above. The thrust produced by the modified outboard motor was also measured at various propeller speeds. The graph depicted in FIG. 9 illustrates the results.

Figure 9:
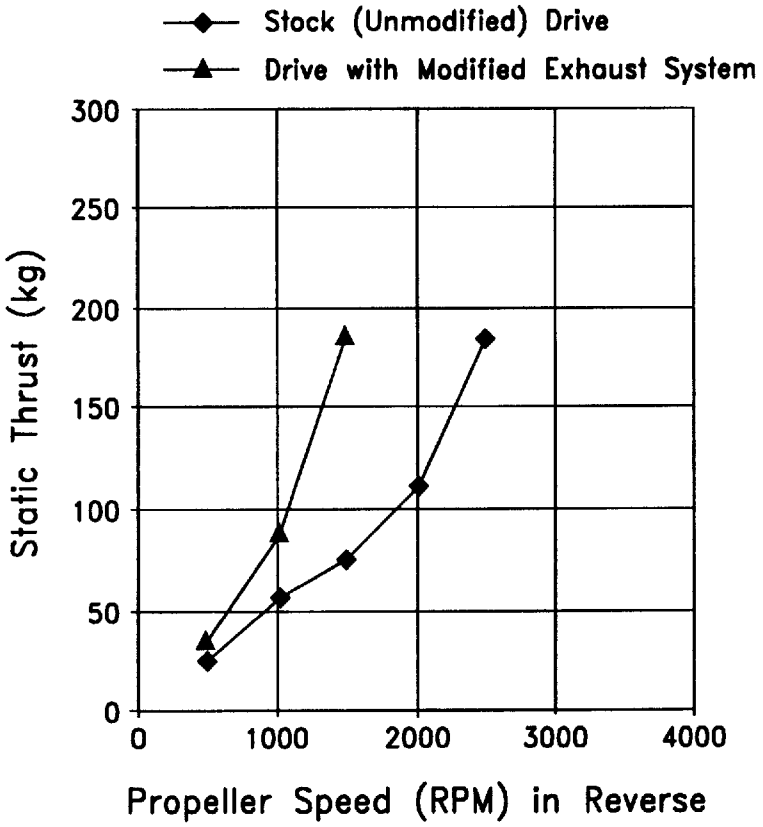
FIG. 9 is a graph comparing static thrust generated by an outboard motor, which is modified to include the present exhaust system, against the static thrust generated by an unmodified outboard motor at various propeller speeds.

As graphically seen in FIG. 9, the outboard motor with the modified exhaust system produced as much as 150% more static torque than that produced by the unmodified outboard motor when operated at the same propeller speed (1500 rpm). The unmodified outboard motor also had to rotate at a significantly higher speed as the outboard motor with a modified exhaust system in order to produce the same static torque (2500 rpm verses 1500 rpm). And even at very low propeller speeds (e.g., 500 rpm), the outboard motor with the modified exhaust system produced more static torque than the unmodified outboard motor.

Figure 10:
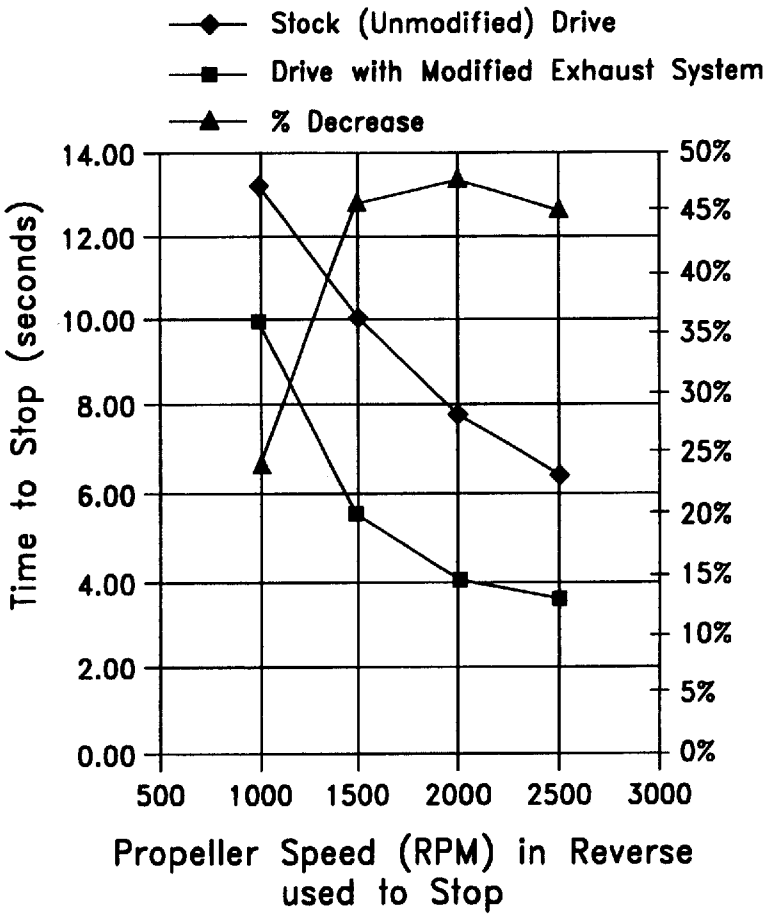
FIG. 10 is a graph comparing watercraft stop time achieve by an outboard motor, which is modified to include the present exhaust system, against watercraft stop time achieved by an unmodified outboard motor at various propeller speeds.

The time to stop the watercraft was also measured with both drives at various propeller speeds. FIG. 10 graphically illustrates the results. At all propeller speeds measured, the modified outboard motor stopped the watercraft significantly quicker (at least 25% quicker) than the unmodified outboard motor. The differences in stop time increased at higher propeller speeds with the outboard motor with the modified exhaust system stopping the watercraft in almost half the time it took the unmodified outboard motor to stop the watercraft at the same propeller speed.

These results thus attest to the significant performance advantage achieved with the present exhaust system. An outboard motor with the present exhaust system produces greater reverse thrust and thus stops the forward movement of the associated watercraft quicker than some prior outboard motors. As a result, the watercraft becomes more maneuverable and responsive, especially when docking the watercraft or traveling through a marina.

In addition, the present exhaust system can be easily adapted into most outboard motor designs. All of the components of the flow control device and the associated operator, as well as the exhaust passages, are all contained in the lower unit. Substantial retooling for the modified outboard motor design therefore is not required. As a result of the integral design within the lower unit, existing outboard motors can also be easily retrofitted with the exhaust system 12.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. An outboard drive for a watercraft comprising a propulsion device which operates under at least a forward drive condition and a reverse drive condition, through a range of speeds under both conditions, to propel the watercraft forward and in reverse, respectively, an engine coupled to the propulsion device to power the propulsion device, and an exhaust system connected to the engine to discharge engine exhaust gases from the outboard drive, the exhaust system including a first exhaust passage terminating at a first discharge end located on the outboard drive at a position that is submerged in the body of water in which the watercraft is operated when the propulsion device is operated at a speed within the range of speeds for at least the forward drive condition and a second exhaust passage communicating with the first exhaust passage and terminating at a second discharge end located on the outboard drive at a position that is below the surface of the body of water in which the watercraft is operated when the propulsion device is operated at a speed within the range of speeds for at least the reverse drive condition, said first discharge end being located at a lower position on the outboard drive than the second discharge end, and a flow control device positioned within the exhaust system, the flow control device being movable between at least a first operational state, in which the flow control device inhibits exhaust gas flow trough the second exhaust passage when the propulsion device is operated under the forward drive condition, and a second operational state, in which the flow control device permits exhaust gas flow through the second exhaust passage to the second discharge end when the propulsion device is operated under the reverse drive condition.

2. An outboard drive as in claim 1, wherein the flow control device includes a valve plate which is movable between at least a first position, which corresponds to the first operational state of the flow control device, and a second position, which corresponds to the second operational state of the flow control device.

3. An outboard drive as in claim 2, wherein the valve plate is positioned within the second exhaust passage.

4. An outboard drive as in claim 3, wherein the valve plate is arranged to lie within the second exhaust passage when in both the first and second positions.

5. An outboard drive as in claim 2, wherein the valve plate is arranged to rotate between the first and second positions.

6. An outboard drive as in claim 5, wherein the valve plate is formed on a rotary valve member.

7. An outboard drive as in claim 5, wherein a biasing member is coupled to the valve plate to bias the valve plate toward the first position.

8. An outboard drive as in claim 1, wherein the second discharge end is located on the outboard drive at a position that is no lower than just below the surface of the body of water when the propulsion device is operated at a speed within the range of speeds for at least the reverse drive condition.

9. An outboard drive as in claim 1, wherein the flow control valve fully closes the second exhaust passage from the first exhaust passage when the propulsion device is operated under the forward drive condition.

10. An outboard drive as in claim 1, wherein the flow control device is arranged within the exhaust system to permit exhaust gas flow through the first exhaust passage when the flow control valve operates under the second operational state.

11. An outboard drive as in claim 10, wherein the first and second exhaust passages and the corresponding first and second discharge ends are arranged within the outboard drive such that a larger volume of exhaust gases flow through the first discharge end with the flow control device in the first operational state than the volume of exhaust gases that flow through the first discharge end with the flow control device in the second operational state.

12. An outboard drive as in claim 1, additionally including a cavitation plate located at least above a portion of the propulsion device, and the second discharge end is located in the vicinity of the cavitation plate.

13. An outboard drive as in claim 12, wherein the second discharge end is located above the cavitation plate.

14. An outboard drive for a watercraft comprising a propulsion device which operates under at least a forward drive condition and a reverse drive condition to propel the watercraft forward and in reverse, respectively, an engine coupled to the propulsion device at least in part by a drive shaft to power the propulsion device, an upper housing and a lower housing depending from the upper housing, the drive shaft extending through at least portions of the upper and lower housings with a relatively greater length of the drive shaft disposed in the upper housing than in the lower housing, the lower housing containing at least part of a propulsion shaft of the propulsion device and supporting the propulsion device within the body of water in which the outboard drive is operated, said propulsion device being positioned to lie behind a lower rear side of the lower housing, and an exhaust system connected to the engine to discharge engine exhaust gases from the outboard drive, the exhaust system including a first exhaust passage terminating at a first discharge end, at least a portion of said first exhaust passage extending through the lower housing with the discharge end of the first passage opening into the body of water at a point behind the propulsion device, a second exhaust passage communicating with the first exhaust passage and terminating at a second discharge end located at a higher position on the outboard drive than the first discharge end, at least a portion of said second exhaust passage extending through the lower housing, and a flow control device positioned within the exhaust system, the flow control device being movable between at least a first operational state, in which the flow control device inhibits exhaust gas flow through the second exhaust passage when the propulsion device is operated under the forward drive condition, and a second operational state, in which the flow control device permits exhaust gas flow through the second exhaust passage to the second discharge end when the propulsion device is operated under the reverse drive condition.

15. An outboard drive as in claim 14, wherein the lower housing additionally includes a cavitation plate located at least above a portion of the propulsion device, and the second discharge end is located above the cavitation plate.

16. An outboard drive as in claim 15, wherein the second discharge end includes a plurality of apertures located on at least one side of the lower housing at a position near a rear end of the lower housing.

17. An outboard drive as in claim 14 additionally comprising a drive train that connects the engine to the propulsion device with the engine located above the propulsion device, the drive train including a vertically-oriented drive shaft coupled to and depending from the engine, and a drive shaft housing arranged between the engine and the lower housing and housing at least a portion of the drive shaft, the exhaust system additionally including an exhaust pipe connected to the engine and an expansion chamber housed within the drive shaft housing and communicating with the exhaust pipe, at least the first exhaust passage also communicating with the expansion chamber.

18. An outboard drive as in claim 17, wherein the propulsion device includes at least one propeller having a hub, and the first exhaust passage extends through a lower portion of the drive shaft housing, through the lower housing and through the propeller hub.

19. An outboard drive as in claim 18, wherein the second passage branches from the first passage at a point located within the lower housing.

20. An outboard drive as in claim 19, wherein the second passage has a flow axis that is generally parallel to a rotational axis of the propeller.

21. An outboard drive as in claim 14, wherein the lower housing houses the flow control device.

22. An outboard drive as in claim 21, additionally comprising a drive train connecting the engine to the propulsion device, the drive train including a transmission that selectively establishes the forward or reverse drive condition for the propulsion device, and a shift actuator coupled to the transmission and coupled to the flow control device to control exhaust gas flow through the second exhaust passage depending upon the operating condition of the propulsion device.

23. An outboard drive as in claim 22, wherein the shift actuator is located within the lower housing.

24. An outboard drive for a watercraft as in claim 1 further comprising a transmission which selectively establishes at least the forward and reverse drive conditions for the propulsion device, and a shift actuator coupled to the transmission to control the operating condition of the propulsion device and coupled to the flow control device to control exhaust flow gases through the exhaust passage.

25. An outboard drive as in claim 24, wherein the shift actuator is coupled to the flow control device in a manner allowing the shift actuator to control the operation of the flow control device so depending upon the drive condition of the transmission.

26. An outboard drive as in claim 24, wherein the flow control device includes a valve plate that is adapted to be moved between an open position and a closed position.

27. An outboard drive as in claim 26 additionally comprising a valve operator arranged between the valve plate and the shift actuator to cause the valve plate to move between the open and closed positions with reciprocal movement of the shift actuator.

28. An outboard drive as in claim 27 wherein the valve operator is adapted to move the valve plate to the open position when the shift actuator is in a position that actuates the transmission to establish a reverse drive condition for the propulsion device.

29. An outboard drive as in claim 28, wherein the valve operator is further adapted to move the valve plate to the closed position when the shift actuator is in a position that actuates the transmission to establish a forward drive condition for the propulsion device.

30. An outboard drive as in claim 27 additionally comprising a lower housing supporting the propulsion device within the body of water in which the outboard drive is operated, the exhaust passage including a first path that extends through the lower housing and through the propulsion device to a first discharge end, and a second path that extends from the first path through a portion of said lower housing to a second discharge end.

31. An outboard drive as in claim 30, wherein the valve plate is positioned within the second path.

32. An outboard drive as in claim 31, wherein the lower housing houses the valve operator and the shift actuator.

33. An outboard drive for a watercraft comprising a propulsion device including a propulsion shaft, an engine coupled to the propulsion device to power the propulsion device by a drive shaft, an upper unit and a lower unit depending from the upper unit, the drive shaft extending through at least portions of the upper and lower units with a relatively greater length of the drive shaft disposed in the upper unit than in the lower unit, the lower unit containing at least part of the propulsion shaft, and an exhaust system connected to the engine to discharge engine exhaust gases from the outboard drive, the exhaust system including at least a first passage and a second passage that communicates with the first passage, and flow control means for controlling exhaust gas flow through the second passage, said flow control means located within the lower unit.

34. An outboard drive as in claim 33, wherein said propulsion device is adapted to operate under at least two drive conditions, and said flow control means inhibits flow through the second passage when the propulsion device operates under at least one drive condition.

35. An outboard drive as in claim 33, wherein the propulsion device operates under at least two drive conditions through a range of speeds under such conditions, and the first passage terminates at a first discharge port that is submerged when the propulsion device is operated at a speed within the range of speeds for at least one of the drive conditions, and the second passage terminates at at least a second discharge port that opens directly to the atmosphere when the propulsion device is operated at said speed within the range of speeds for said drive condition.

36. An outboard drive as in claim 35, wherein the first passage extends through the lower unit and through the propulsion device to the first discharge port, and a second passage extends from the first passage through a portion of said lower unit to the second discharge port.

37. A method for increasing the performance of an outboard drive of a watercraft while silencing exhaust gases when operating under a reverse drive condition in a body of water, said method comprising the steps of:

providing an engine with at least one exhaust port and an exhaust system communicating with the exhaust port of the engine, the exhaust system including a first exhaust passage that terminates at a first discharge end and a second passage that terminates at a second discharge end, and a flow control device arranged to control exhaust gas flow through the second passage;

providing a transmission to selectively establish at least a forward and a reverse drive condition for the outboard drive, the outboard drive being capable of running through a range of speeds for at least the forward and reverse drive conditions;

positioning the first discharge end at a location that lies submerged in the body of water in which the outboard drive is operated when the outboard drive is operated at a speed within the range of speeds for at least the forward drive condition, and positioning the second discharge end at a location that lies higher than the first discharge end on the outboard drive and is below the surface of the body of water in which the watercraft is operated when the outboard drive is operated at a speed within the range of speeds for at least the reverse drive condition; and operating the flow control valve to permit exhaust gas flow through the second passage when the transmission establishes a reverse drive condition for the outboard drive, whereby at a least a portion of the exhaust gases from the engine are discharged through the second passage and associated discharge end when the outboard drive is operated in reverse.

38. A method as in claim 37 additionally comprising flowing a smaller portion of exhaust gases through the first exhaust passage than through the second exhaust passage when the outboard drive is operated in reverse.

39. A method as in claim 38 additionally comprising operating the flow control valve to inhibit exhaust gas flow through the second passage when the transmission establishes a forward drive condition for the outboard drive, whereby a majority of the exhaust gases from the engine are discharged through the first passage, through the propulsion device and through the first discharge end when the outboard drive propels the watercraft forward.

40. A method as in claim 39 additionally comprising flowing a smaller volume of exhaust gases through the first discharge end with the outboard drive operating under a reverse drive condition than the volume of exhaust gases flowing through the first discharge end with the outboard drive operating under a forward drive condition.

41. An outboard drive for a watercraft comprising a propulsion device which operates under at least a forward drive condition and a reverse drive condition to propel the watercraft forward and in reverse, respectively, an engine coupled to the propulsion device to power the propulsion device, the engine including at least one exhaust port and an exhaust system connected to the engine to discharge engine exhaust gases from the outboard drive, the exhaust system including a first exhaust passage communicating with the exhaust port of the engine and terminating at a first discharge end, and a second exhaust passage communicating with the first exhaust passage so as to receive exhaust gases therefrom and terminating at a second discharge end, the first discharge end being located on the outboard drive at a position lower than the position of the second discharge end on the outboard drive, and a flow control device positioned within the exhaust system at a position that is below the surface of the body of water in which the watercraft is operated when the propulsion device is operated under at least some speeds in the reverse drive condition, the flow control device being movable between at least a first operational state, in which the flow control device inhibits exhaust gas flow through the second exhaust passage when the propulsion device is operated under the forward drive condition, and a second operational state, in which the flow control device permits exhaust gas flow through the second exhaust passage to the second discharge end when the propulsion device is operated under the reverse drive condition.

42. An outboard drive for a watercraft comprising a propulsion device which operates under at least a forward drive condition and a reverse drive condition to propel the watercraft forward and in reverse, respectively, an engine coupled to the propulsion device to power the propulsion device, a lower housing supporting the propulsion device within the body of water in which the outboard drive is operated, said propulsion device being positioned to lie behind a lower rear side of the lower housing, and an exhaust system connected to the engine to discharge engine exhaust gases from the outboard drive, the exhaust system including a first exhaust passage terminating at a first discharge end, at least a portion of said first exhaust passage extending through the lower housing with the discharge end of the first passage opening into the body of water at a point behind the propulsion device, a second exhaust passage communicating with the first exhaust passage and terminating at a second discharge end located at a higher position on the outboard drive than the first discharge end, at least a portion of said second exhaust passage extending through the lower housing, and a flow control device positioned within the exhaust system and located at a position which is below the surface of the body of water in which the watercraft is operated when the propulsion device is operated at least under some speeds in the reverse drive condition, the flow control device being movable between at least a first operational state, in which the flow control device inhibits exhaust gas flow through the second exhaust passage when the propulsion device is operated under the forward drive condition, and a second operational state, in which the flow control device permits exhaust gas flow through the second exhaust passage to the second discharge end when the propulsion device is operated under the reverse drive condition.

* * * * *